US005463839A

United States Patent [19]

Stange et al.

[11] Patent Number: 5,463,839

[45] Date of Patent: Nov. 7, 1995

[54] APPARATUS FOR PACKAGING A PREDETERMINED QUANTITY OF OBJECTS AND A COUNTING DEVICE THEREFOR

[75] Inventors: Thomas C. Stange, Athol; James M. DiNanno, Wakefield; John P. Maillet, Jr., Boylston; Richard N. Heino, Westminster, all of Mass.

[73] Assignee: The Lakso Company, Leominster, Mass.

[21] Appl. No.: 285,806

[22] Filed: Aug. 4, 1994

[51] Int. Cl.[6] ..... B65B 5/10; B65B 35/56; B65B 57/10; B65B 57/20

[52] U.S. Cl. ..... 53/54; 53/250; 53/501; 53/504; 53/544; 53/900

[58] Field of Search ..... 53/54, 53, 55, 53/52, 501, 500, 504, 544, 77, 900, 250, 249, 251, 244, 236, 235, 143, 142, 284.5

[56] References Cited

U.S. PATENT DOCUMENTS

| | | | |
|---|---|---|---|
| 1,755,721 | 4/1930 | Winkler et al. . | |
| 2,632,588 | 1/1952 | Hoar, Jr. . | |
| 2,763,108 | 4/1952 | Garrett . | |
| 2,803,406 | 5/1955 | Nuttall . | |
| 2,939,567 | 1/1958 | Mazura et al. . | |
| 3,011,678 | 7/1957 | McClosky et al. . | |
| 3,018,595 | 1/1962 | Harris et al. | 53/501 |
| 3,081,588 | 3/1964 | Klapes et al. | 53/501 |
| 3,139,713 | 3/1962 | Merrill et al. | 53/55 |
| 3,193,196 | 7/1965 | Merrill et al. | 53/501 X |
| 3,290,488 | 7/1966 | Sewell . | |
| 3,490,197 | 1/1970 | Cremieux | 53/500 X |
| 3,677,437 | 7/1972 | Haigler | 53/501 X |
| 3,705,475 | 12/1972 | Riley | 53/501 X |
| 3,730,386 | 5/1973 | Monsees | 53/500 X |
| 3,746,211 | 7/1973 | Burgess, Jr. . | |
| 3,928,753 | 12/1975 | Kivett et al. | 235/92 PK |
| 4,204,224 | 5/1980 | Buken et al. | 358/107 |
| 4,241,293 | 12/1980 | Bross | 235/92 PK |
| 4,245,243 | 1/1981 | Gutjahr et al. | 358/106 |
| 4,655,026 | 4/1987 | Wigoda | 53/55 |
| 4,674,259 | 6/1987 | Hills | 53/202 |
| 4,677,283 | 6/1987 | Lewis | 235/98 |
| 4,875,093 | 10/1989 | Koishi et al. | 358/83 |
| 4,945,416 | 7/1990 | Slagues et al. | 358/209 |
| 4,980,292 | 12/1990 | Elbert et al. | 435/289 |
| 5,016,281 | 5/1991 | Eppler et al. | 382/1 |
| 5,105,930 | 4/1992 | Spatafora et al. | 198/435 |

OTHER PUBLICATIONS

Product literature re the "LAPP1100 Camera and MAPP2200 Optical Sensor", 9 pages, Jun. 25, 1993.

Product literature re "The Swiftpack* Counter", 5 pages, Jun. 25, 1993.

Product literature re the "Cremer CF830–model–2" electronic counter", 6 pages, Jun. 25, 1993.

Product literature re the "King Tablet Counter Model TC12", King Packaging Machinery, 1 page, Jun. 25, 1993.

Product literature re a "Proposed Bottle Filler", Aylward Enterprises, Inc., 2 pages, Jun. 25, 1993.

Product literature re "KL100—Advanced Counting Technology", Kirby Lester Inc., 1 page, Jun. 25, 1993.

Product literature re "Vi–Count" tablet counting machine, 1 page, Jun. 25, 1993.

Product literature re the "Model 58 Electronic Counting Machine", The Lakso Company, 2 pages, Feb. 1962.

*Primary Examiner*—James F. Coan
*Attorney, Agent, or Firm*—McCormick, Paulding & Huber

[57] ABSTRACT

An apparatus for packaging a predetermined quantity of objects and a counting device therefor is disclosed. The counting device includes a feed tray for singularizing objects, and the tray has at least one guide path including segments defining a direction of movement along the path oriented at an angle with respect to the drive axis of the tray. The packaging apparatus includes the counting device and associated components and controls for the automatic, high speed filling of containers.

18 Claims, 11 Drawing Sheets

APPARATUS FOR PACKAGING A PREDETERMINED QUANTITY OF OBJECTS AND A COUNTING DEVICE THEREFOR

FIELD OF THE INVENTION

The present invention relates to an apparatus for counting and packaging small, discrete objects such as, for example, tablets and capsules. More particularly, the present invention relates to an apparatus for the automatic, high speed counting of such objects into predetermined quantities for subsequent packaging.

BACKGROUND OF THE INVENTION

Automatic high speed counting and packaging apparatus of the general type considered here are used routinely by pharmaceutical manufactures to package predetermined quantities of pills, tablets, capsules and similar discrete dosage forms. To meet the requirements of the pharmaceutical industry, such apparatus must be capable of rapidly filling a large number of containers, typically on the order of one hundred to several hundred containers per minute, with a quantity of product which corresponds to the predetermined quantity. In addition, the apparatus should be able to accurately distinguish chipped, broken or otherwise damage product from intact product and segregate containers containing damage product for additional processing. Finally, since automatic counting and filling apparatus are typically used to package several different products, the machine should be designed such that it can be easily disassembled, thoroughly cleaned and reassembled in order to minimize down time. In this connection, the machine should also be designed so that product changeover requires only minimum parts substitution.

Several different types of automatic counting and packaging apparatus are currently available. Slat counters, perhaps the fastest devices of this type, include slats fitted onto a moving chain which rotates the slats through a hopper containing tablets or capsules. The slats have a predetermined number of cavities corresponding to the predetermined quantity of product to be packaged, and each cavity is filed with, for example, a table as the slat rotates through the hopper. As each slat is moved to an unloading position, the predetermined number of tablets are directed into a container. While such a device is capable of filling up to four hundred containers per minute, the down time required for cleaning the device and adapting it for a different product size, shape or predetermined quantity is substantial. This is so primarily because different product sizes and quantities require that every slat in the device be changed. Thus, in addition to the considerable down time associated with cleaning and product changeover, devices of this type require an inventory of many sets of different slats.

Disk counters are another type of commercially available automatic counting and filling apparatus. These devices include a rotating disk which has a series of holes to hold tablets, capsules or similar products. The holes are filled with product in one area of the device, and as the disk rotates to another part of the device, the product falls out of the holes and is diverted into a container. As in the case of the above-described slat counter, the disk counter is difficult to clean and a change in either product size or quantity requires that the disk be changed, which in turn results in significant down time for the device.

Counters are also known which continuously drop product from a hopper onto a vibrating feed tray which advances the product downstream to a photosensor for counting. When a quantity of product equaling the predetermined quantity has been counted by the photosensor, the product is directed into a container. Such devices present a number of disadvantages. First, a considerable distance must be provided between the hopper and the photosensor to ensure that the feed tray has singularized or separated the product sufficiently to be counted. Second, the photosensor typically found in such devices is an opposed beam photoelectric sensor comprising a light source and an opposed receiver. When an object passes in front of the sensor, the beam is interrupted, thus signaling a controller to count the respective object. Because these sensors typically lack the requisite sensitivity, they cannot sufficiently distinguish between products of different size. Thus, the sensor is unable to consistently differentiate between damaged or defective product and intact product. On the other hand, such devices may be so sensitive that they are incapable of differentiating between the objects to be counted and other loose debris or particles, such as chips from damaged product and dust. Thus, the filled container too frequently contains damaged product and a quantity of product which does not correspond to the predetermined amount.

It is, therefore, an object of the present invention to provide a counting device that rapidly separates and accurately counts predetermined quantities of discrete objects, such as tablets and capsules.

It is a further object of the present invention to provide such a device the consistently distinguishes between damaged and undamaged product.

It is yet another object of the invention to provide an automatic, high-speed counting and packaging apparatus for packaging predetermined quantities of discrete objects.

It is a still further object of the invention to provide such an apparatus which is easily cleaned and which can be quickly adapted to count and package different predetermined quantities of products of varying size and shape.

SUMMARY OF THE INVENTION

In one aspect, the present invention provides a device for counting a predetermined quantity of discrete objects. While the apparatus will be described in connection with counting dosage forms such a tablets and capsules, the apparatus may be used to count any small discrete objects, such as nuts, bolts screws, buttons, etc.

The device includes a feed tray which defines an axis extending between an inlet portion and a discharge portion of the tray. Objects deposited on the inlet portion of the tray are advanced along the axis and are singularized or separated from one another for counting by the time they arrive at the discharge portion of the tray. The tray has at least one guide path including a plurality of segments for transporting objects from the inlet to the discharge portion of the tray. Each of the objects defines a direction of movement along the axis, and at least some of the segments are oriented at an angle with respect to the axis, the angle at which respective segments are oriented becoming decreasingly oblique toward the discharge portion of the tray.

The device further includes means for advancing objects along the guide path from the inlet portion toward the discharge portion of the tray. Since the guide path includes at least some segments which define a direction of movement oriented at an angle with respect to the axis, and since the angle becomes decreasingly oblique toward the discharge portion of the feed tray, objects advance along the guide path at differing velocities depending on their particular location on the path. For example, objects located on a segment of the path near the inlet portion of the tray and having a direction of movement oriented at highly oblique angle to the axis move at a much slower velocity than objects located on a segment of the path near the discharge portion of the tray and having a direction of movement oriented parallel or nearly parallel to the axis. This is the case because objects having a direction of movement oriented at an angle with respect to the axis have a velocity component directed transverse to the axis. The more oblique the angle, the greater this component is.

Due to the differing velocities at which objects advance along the guide path, the tray is able to rapidly singularizing the objects as they advance from the inlet portion to the discharge portion of the feed tray. Accordingly, the present invention employs a feed tray which is much shorter than those typically found in prior art automatic counting devices, wherein the guide paths extend parallel to the axis throughout their entire length. Moreover, the apparatus taught by the invention is capable of effecting a complete separation of the objects from one another while operating at much higher object feed velocities as compared with prior art devices.

The device also includes means for counting the quantity of singularized objects received at the discharge portion of the tray and means for interrupting the advancement of objects along the guide path when the quantity of objects counted equals the predetermined quantity. Control means connected to the means for counting and the means for interrupting is also provided. The control means receives data from the counting means which correspond to the quantity of objects counted, and the control means activates the means for interrupting to temporarily stop the advancement of objects along the guide path when the data received correspond to the predetermined quantity.

In the preferred embodiment of the invention, the feed tray has a plurality of guide paths each of which includes a plurality of reversely arcuate segments which increase in radius toward the discharge portion of the tray. Thus, the guide paths define an undulating or wave like pattern, wherein the waves become flatter, i.e., decreasingly less arcuate, toward the discharge portion of the feed tray.

The counting means in the preferred embodiment of the invention comprises a camera for imaging objects advancing along the guide paths, an optical sensor for registering the image of each object as a pixel array, and a processor for converting the registered image into data to be forwarded to the control means. In the preferred embodiment the data for groups of at least two guide paths are combined, and when the data correspond to the predetermined quantity, the control means activates the means for interrupting to temporarily stop the advancement of objects along that group of guide paths.

The means for interrupting utilized in the preferred embodiment includes a manifold supporting a plurality of pneumatically operated gates. The gates comprise a piston and cylinder assembly actuated between an open position and a closed position by an associated solenoid connected to the control means for alternately permitting and interrupting advancement of objects along the guide path.

In a second aspect, the present invention provides an apparatus for counting and packaging a predetermined quantity of objects. The apparatus includes the counting device described above together with means for transferring objects from the discharge portion of the tray to a container to fill the container with the predetermined quantity of objects. The apparatus further includes means for delivering at least one empty container to a fill position for receiving the predetermined quantity of objects from the transfer means, means for discharging the filled container from the fill position, and means for segregating filled bottles containing intact product from those containing damaged or defective objects.

In a preferred embodiment of the invention, a conveyor is provided for delivering empty bottles to and removing filled bottles from the counting device. The means for transferring the predetermined quantity of objects to the bottles delivered by the conveyor includes a plurality of funnels and associated chutes; each of the funnels receives the predetermined number of objects at its upper end from one or more guide paths and discharges objects from its lower end into an associated chute and then directly into a bottle.

Indexing means associated with the conveyor are provided for moving empty bottles from an infeed lane of the conveyor to a fill position located beneath the lower end of the chutes, and for moving filled bottles from the fill position to a discharge lane of the conveyor. The conveyor is provided with a diverter actuated by the controller to segregate bottles containing damaged product from the discharge lane of the conveyor.

DETAILED DESCRIPTION OF THE PREFERRED EMBODIMENT

Figure 1:
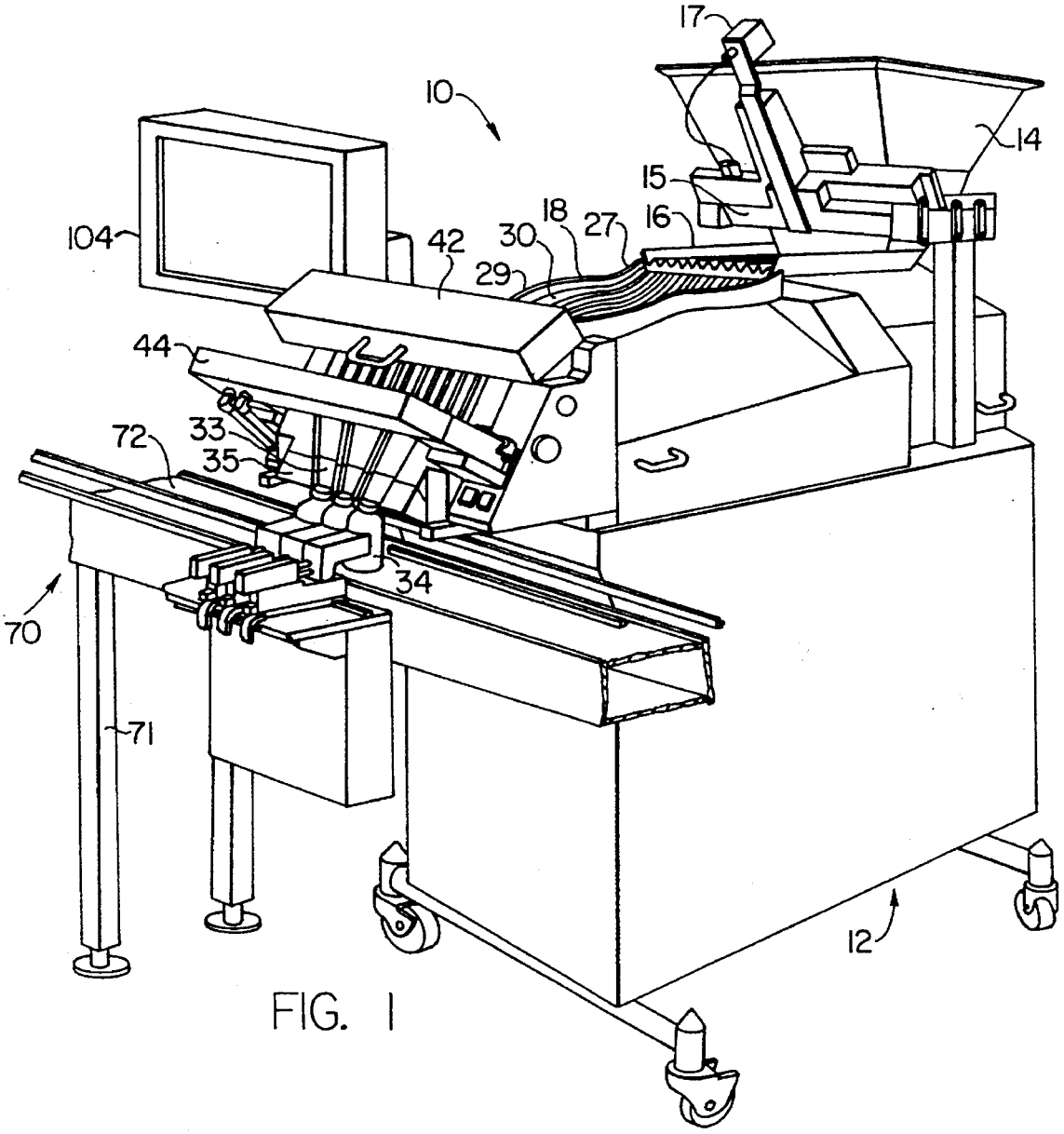
FIG. 1 is a perspective view of an apparatus embodying the present invention for automatically counting and packaging discrete objects.

In FIG. 1, an apparatus embodying the present invention for automatically counting and packaging discrete objects is indicated generally by the reference numeral 10. The apparatus 10 comprises a transportable housing and frame assembly 12 carrying a hopper 14 for holding the discrete objects to be counted and packaged (not shown). A prefeed tray 16 mounted below the hopper, and a main feed tray 18 mounted downstream of the prefeed tray to receive and singularize the objects discharged from the hopper and prefeed tray. The hopper includes a baffle plate 15 for controllably discharging objects onto the preferred tray 16, and a sensor 17 for detecting the level of objects contained in the hopper.

Figure 2:
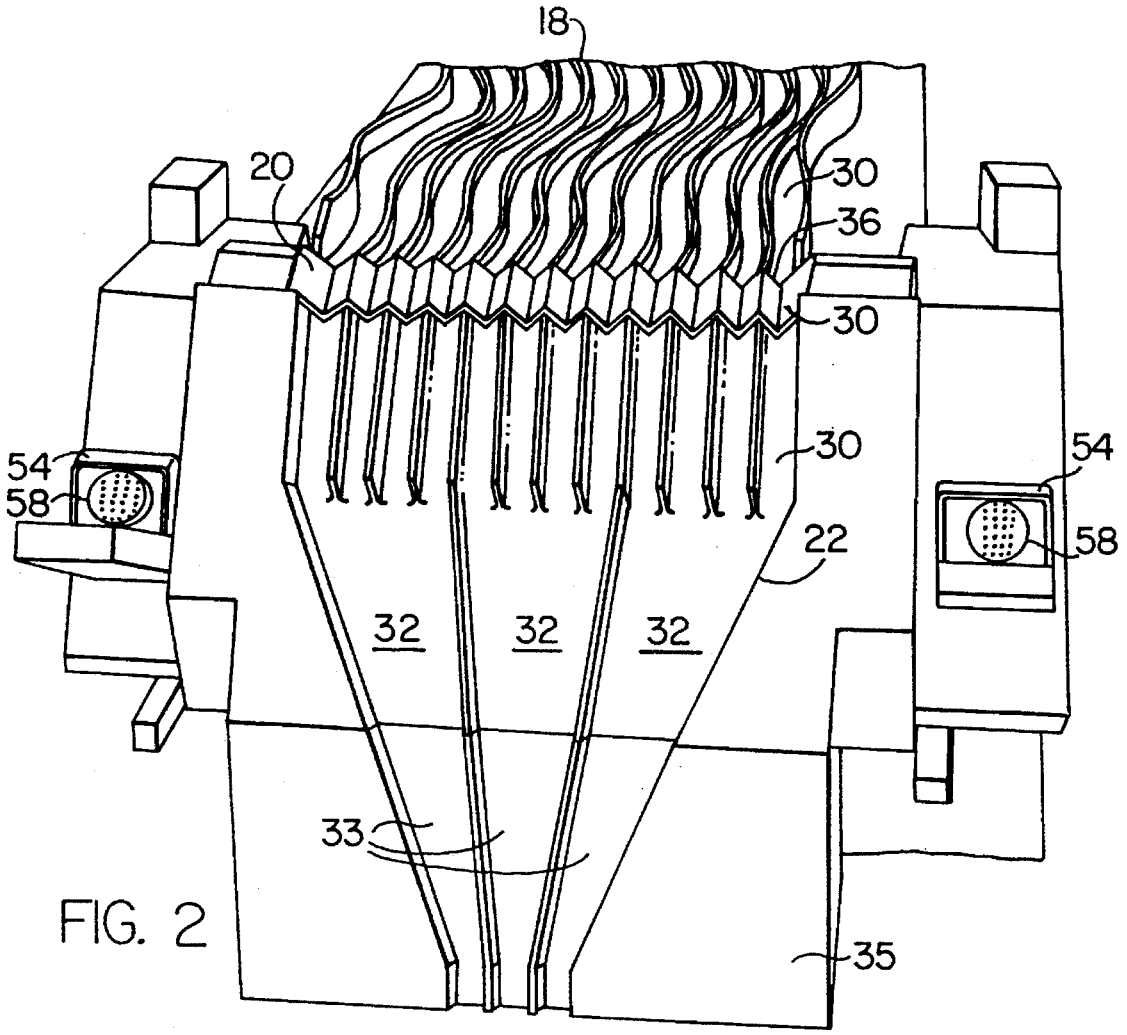
FIG. 2 is a partial front perspective of the apparatus shown in FIG. 1.

As shown in FIG. 2, a transition guide 20 is mounted downstream of the main feed tray 18, and a collection block 22 is mounted downstream of the transition guide to receive the singularized objects from the main feed tray and guide them into respective containers, as is described further below.

Figure 3:
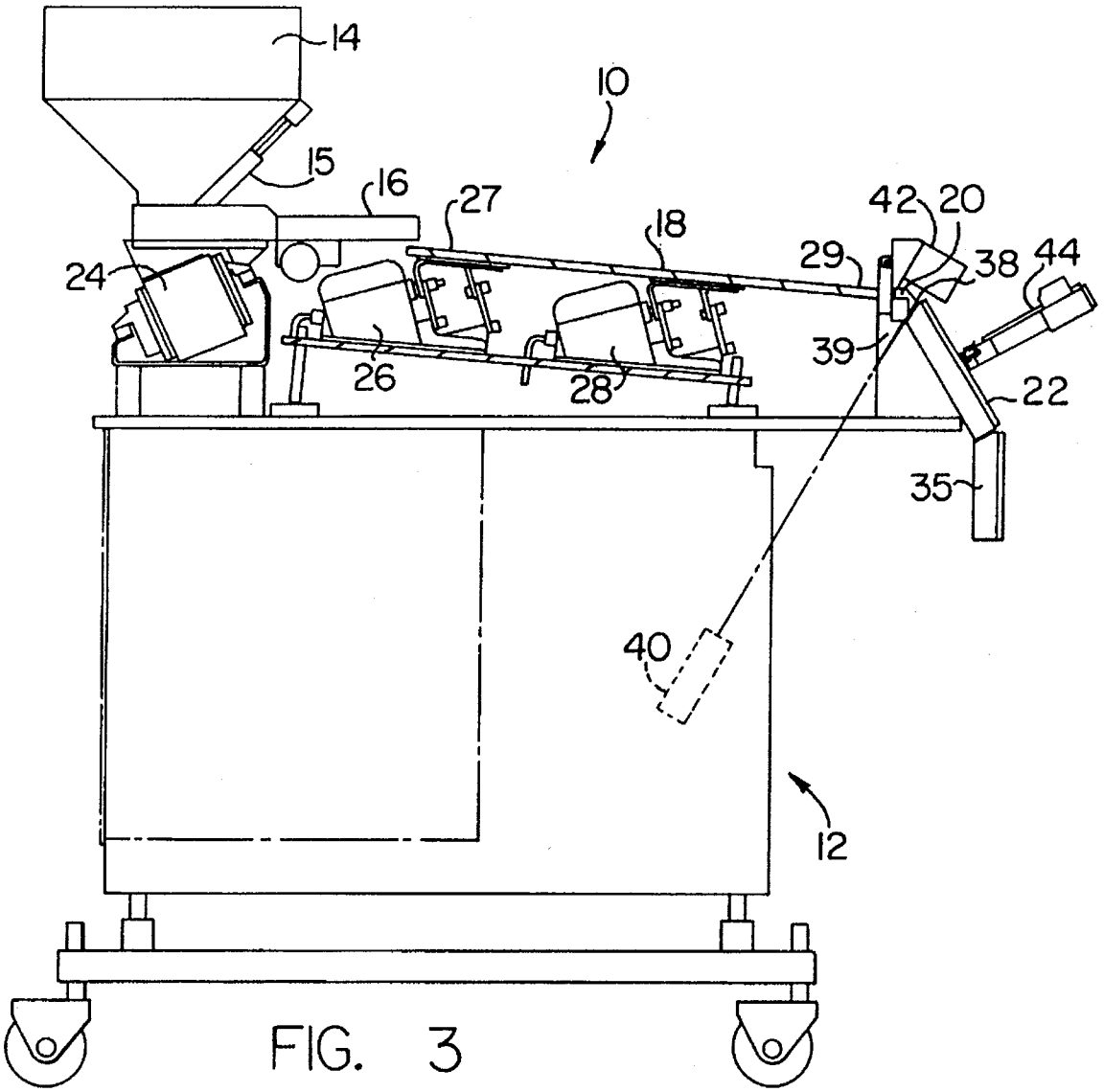
FIG. 3 is a side, elevational view in partial cross section of the apparatus of FIG. 1.

Referring now to FIG. 3, a vibrator 24 is coupled to the prefeed tray 16 to vibrate the tray and in turn drive the objects from one end of the tray to the other. Similarly, a first vibrator 26 is coupled to the inlet portion 27 of the main feed tray 18, and a second vibrator 28 is coupled near the outlet portion 29 to vibrate the tray, and in turn transport and singularize the objects as they move from one end of the tray to the other. As also shown in FIG. 3, the main feed tray also slopes downwardly with respect to the horizontal from its inlet toward its outlet portion to facilitate the transport and singularization of the objects. Typically, the main feed tray is sloped at an angle of from about 3° to about 8° and preferably at an angle of about 7°, although the invention is in no way limited in this regard. Depending on object size, shape and surface characteristics, as well as the optimum object feed velocity, the tray 18 may be sloped more or less than the above-described typical range.

As shown in FIGS. 1 and 2, the prefeed tray 16, main feed tray 18, and transition guide 20 each define a plurality of lanes or guide paths 30 extending from the inlet to the discharge portion of the respective part. As can be seen, the corresponding guide paths of the two feed trays and transition guide are aligned with each other so that as each object is discharged from one part to the next it is maintained within the respective guide path. Of course, the apparatus could employ a greater or lesser number of guide paths, and this is easily accomplished simply by replacing parts 16, 18, 20 and 22 with parts defining the desired number of paths.

Figure 4:
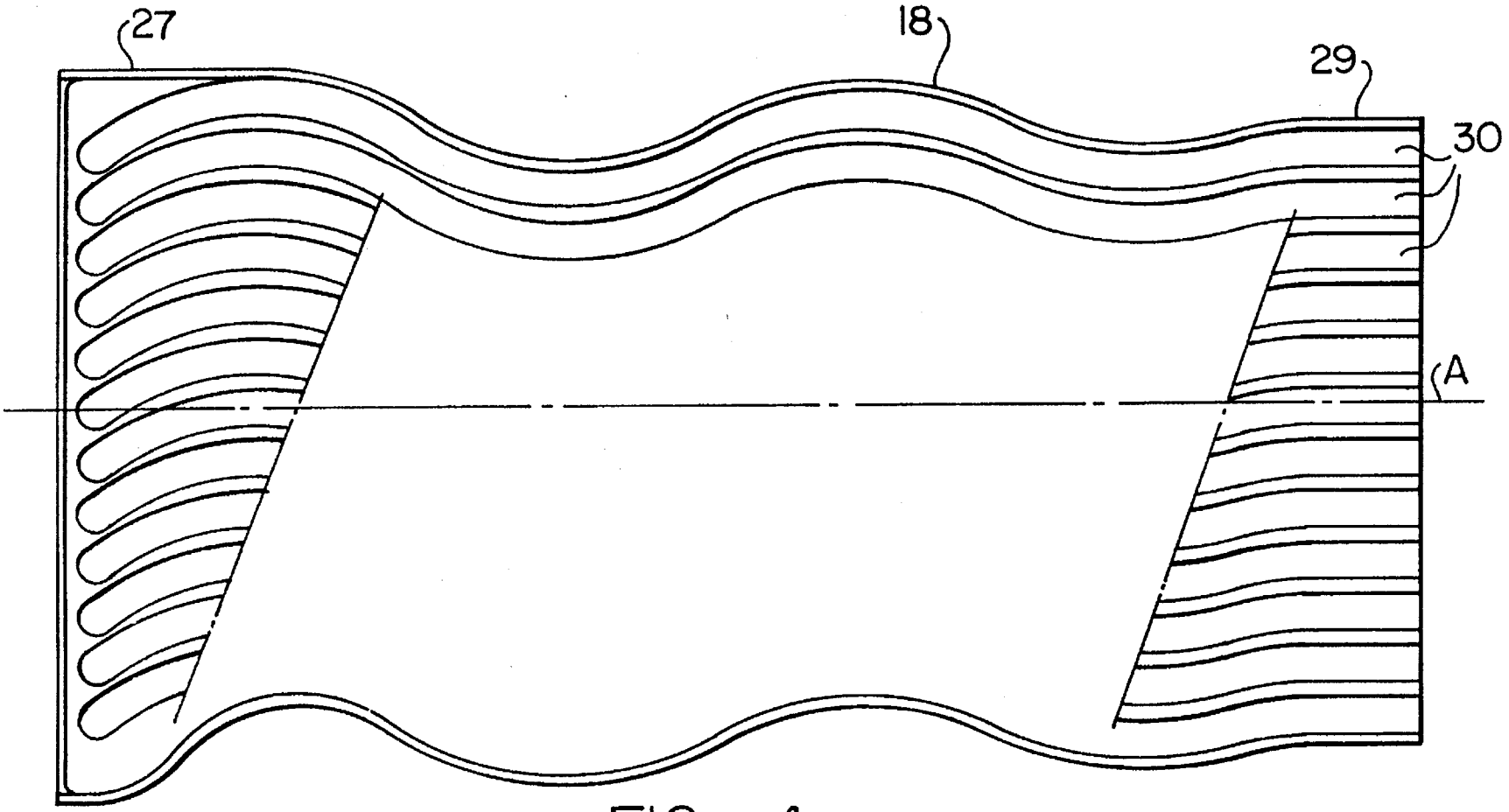
FIG. 4 is a top plan view of the feed tray which forms a part of the apparatus shown in FIG. 1.

As also shown in FIG. 1, and more clearly in FIG. 4, each guide path 30 within the main feed tray 18 defines an undulating or wave-like pattern wherein each wave is decreasingly less arcuate toward the discharge portion of the tray. In other words, a plurality of segments of any guide path each define a respective direction of movement, and the angle defined by each direction of movement with respect to the drive axis of the tray (or with respect to the drive vector of the tray as defined by the direction of movement of the vibrators 26 and 28) becomes decreasingly oblique toward the outlet portion of the tray. This configuration effectively causes objects to advance along each guide path at differing velocities depending upon their locations on the path, thus facilitating a rapid singularization of the objects as they advance from the inlet to the outlet portion of the tray. This configuration also permits the feed tray to be vibrated at higher frequencies and greater amplitudes than prior art devices. For example, the feed tray 18 is typically vibrated at from about 80 Hz to about 100 Hz and preferably about 82 Hz, whereas prior art devices operate at about 60 Hz.

The relatively fast vibrational frequency, high vibrational amplitude and unique configuration of the feed tray of the present invention permit singularizing of the objects at much faster rates than are possible with prior art devices. Thus, whereas prior art devices typically utilize up to three feed trays to singularize objects for counting, the present invention employs a single tray having a length of from only about 20 inches to about 30 inches and preferably about 26 inches. Higher object feed velocities are also possible with a device embodying the present invention as compared with prior art counting and filling apparatus. Whereas prior art devices operate at a feed velocity of no more than about 25 ft./min., the present invention achieves feed velocities of up to 60 ft./min.

It should be appreciated, however, that tray designs other than the illustrated preferred embodiment are within the scope of the invention. Suitable alternative feed tray designs are disclosed in commonly assigned U.S. patent application Ser. No. 08/285,809, entitled "Feed Tray for Singularizing Objects", filed on even date herewith and incorporated by reference as part of the present disclosure.

Referring again to FIGS. 1 and 2, it can be seen that the collection block 22 also defines a plurality of lanes or guide paths 30, each being aligned with a corresponding guide path of the transition piece 20 to receive the respective objects discharged through the lane. The collection block 22 also defines a lane-merging area located downstream of the guide paths 30 formed by three funnel-shaped lanes 32, each funnel being aligned with a group of guide paths to receive the singularized objects from the respective group. Each funnel 32 in turn directs the singularized objects into a respective chute 33 for subsequent discharge directly into a container such as the bottles 36, as is described further below. The chutes 33 are formed together as a single change part 35, and the operator of the apparatus 10 simply selects the part having chutes properly contoured for the size and shape of the particular containers being filled.

With reference to FIGS. 2 and 3, a vacuum slot 36 is defined between the outlet portion of the main feed tray 18 and the inlet end of the transition guide 20, and a sensor slot 38 is defined between the outlet end of the transition guide and the inlet end of the collection block 22. A vacuum manifold 39 is located immediately beneath the vacuum slot 36 to create a suction, and in turn draw any dust or loose particles passing over the slot into the manifold and away from the containers being filled.

An optical sensor 40 is mounted within the housing and frame assembly 12 and aligned with the sensor slot 38, as illustrated in dashed lines in FIG. 3, to scan the singularized objects as they pass over the slot from the transition guide to the collection block. In the preferred embodiment of the invention, the optical sensor 40 is a linear array picture processing camera, such as the "LAPP 1100" camera from Integrated Vision Products AB of Linkoping, Sweden. This particular camera has a linear array (i.e., a single row) of 128 pixels, each pixel having dimensions of 35×35 μm, and has image sensing, digitization and picture-processing capabilities. A background light 42 is mounted on the opposite side of the sensor slot 38 relative to the camera 40 and is tuned to the optimum bandwidth of the camera in order to minimize the effect of any variations in ambient light intensity, object reflectivity or other potential interferences. Preferably, the light 42 is a phosphor lamp tuned to a frequency of about 680 nm. As each object passes over the sensor slot 38 it is repetitively scanned by the camera 40, and the image information is stored to not only count the respective object, but also to assess its length and area, as is described further below.

Figure 5:
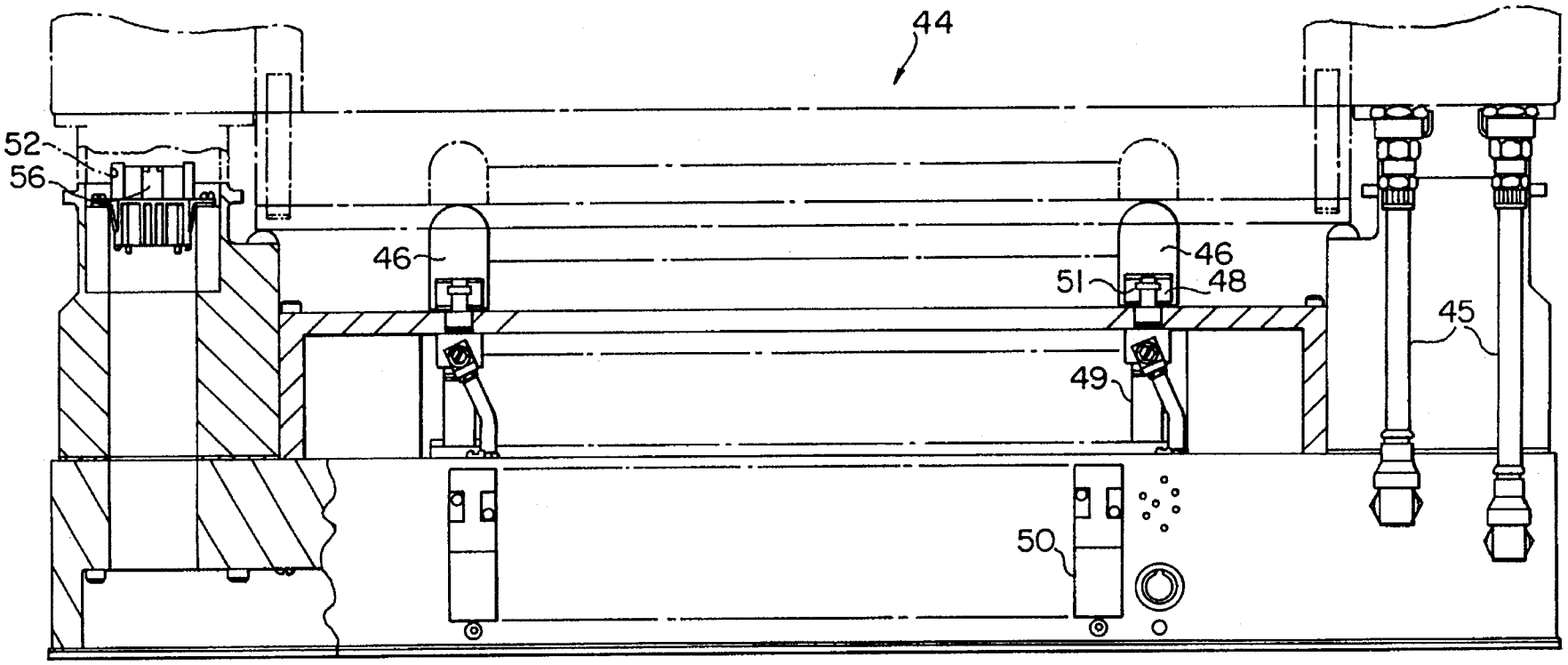
FIG. 5 is a partial bottom plan view of the gating manifold of the apparatus of FIG. 1 for controlling the discharge of singularized objects into containers.

Referring to FIGS. 1, 2 and 5, gating manifold 44 is mounted on the housing and frame assembly 12 adjacent to the collection block 22 and is provided with air intake and return lines 45. The manifold comprises a plurality of gates 46 for controlling the discharge of singularized objects into containers. As shown in FIG. 5, each gate 46 is mounted on a respective sleeve 48 coupled to a pneumatic piston and cylinder assembly 49 and is aligned with a respective guide path 30 on the collection block 22. Each assembly 49 is actuated by a solenoid 50 to drive the respective sleeve and gate between an extended position to block the passage of objects through the respective guide path 30, and a retracted position to permit the passage of objects through the respective guide path, as is described further below. Each gate 46 is preferably made of a plastic material, and defines a mounting aperture 51 forming a snap fit with the free end of the respective sleeve to permit detachment and reassembly of the gates without tools for cleaning and/or reconfiguring the apparatus to process different products.

The gating manifold 44 also includes a pair of sockets 52 (one shown) mounted on opposite ends of the manifold for detachably mounting and electrically connecting the manifold to corresponding mounting pads 54 carried on the housing and frame assembly 12 and shown in FIG. 2. Each socket 52 includes a multi-pin electrical connector 56 connected to a plurality of the gate solenoids 50, and each mounting pad 54 includes a corresponding connector 58 for electrically connecting the gating manifold to the electronic control components of the apparatus upon mounting the manifold to the frame and housing assembly, as is described further below.

Figure 6:
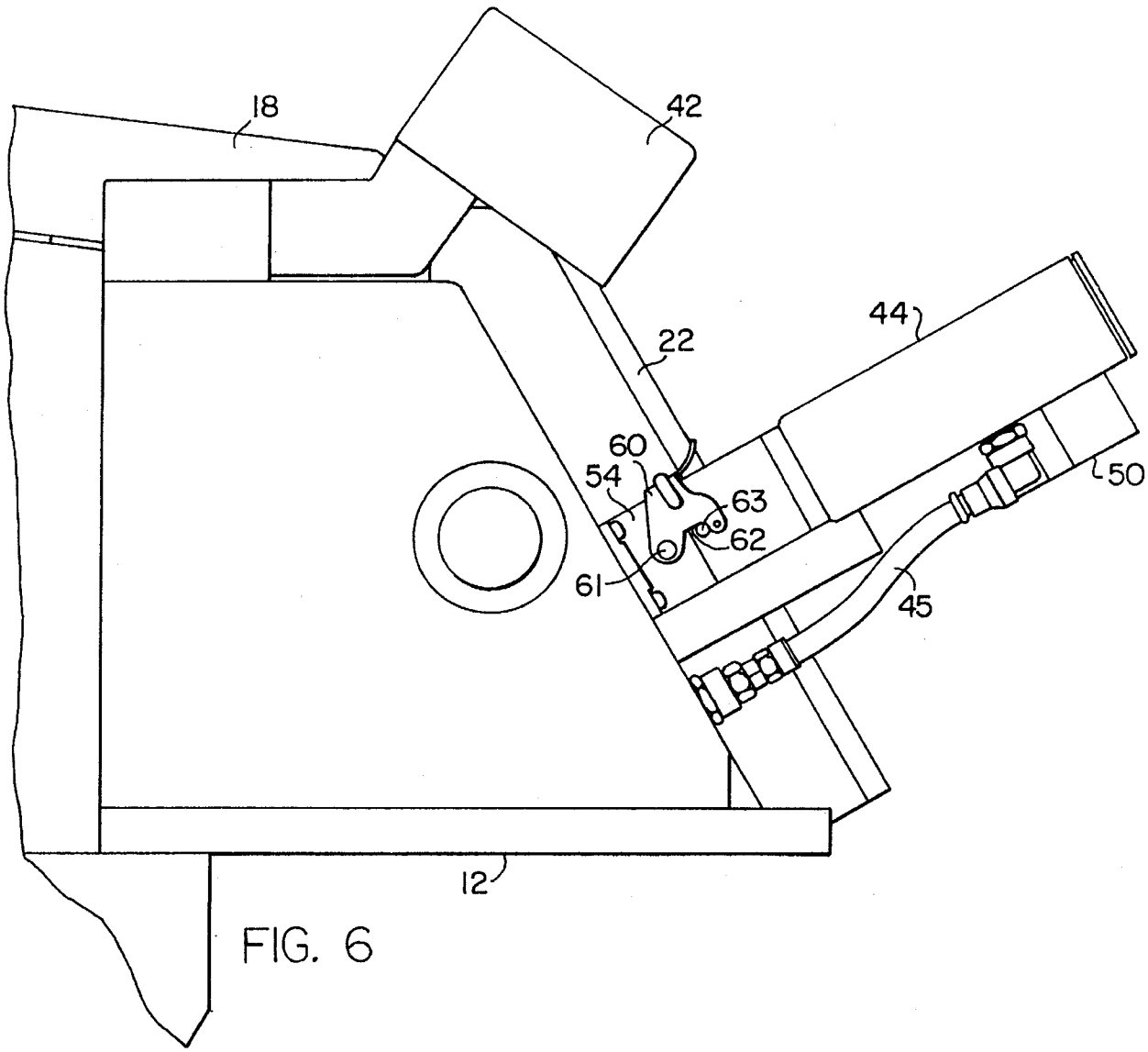
FIG. 6 is a partial side elevation showing the latching mechanism for the gating manifold of FIG. 5.

Referring to FIG. 6, a pair of latches 60 (one shown) are each pivotally mounted to a pivot pin 61 carried by a respective mounting pad 54, and each latch defines a recess 62 to receive a corresponding pin 63 carried by the respective socket 52 to lock the socket to the mounting pad. A pair of support brackets 64 (one shown) are each mounted to the frame and housing assembly 12 below a respective mounting pad 54 to provide additional support for the gating manifold when detachably mounted to the pads. The gating manifold 44 can thus be quickly mounted to and detached from the housing and frame assembly without tools to facilitate changeover for processing different products and/or cleaning of the apparatus.

Figure 7:
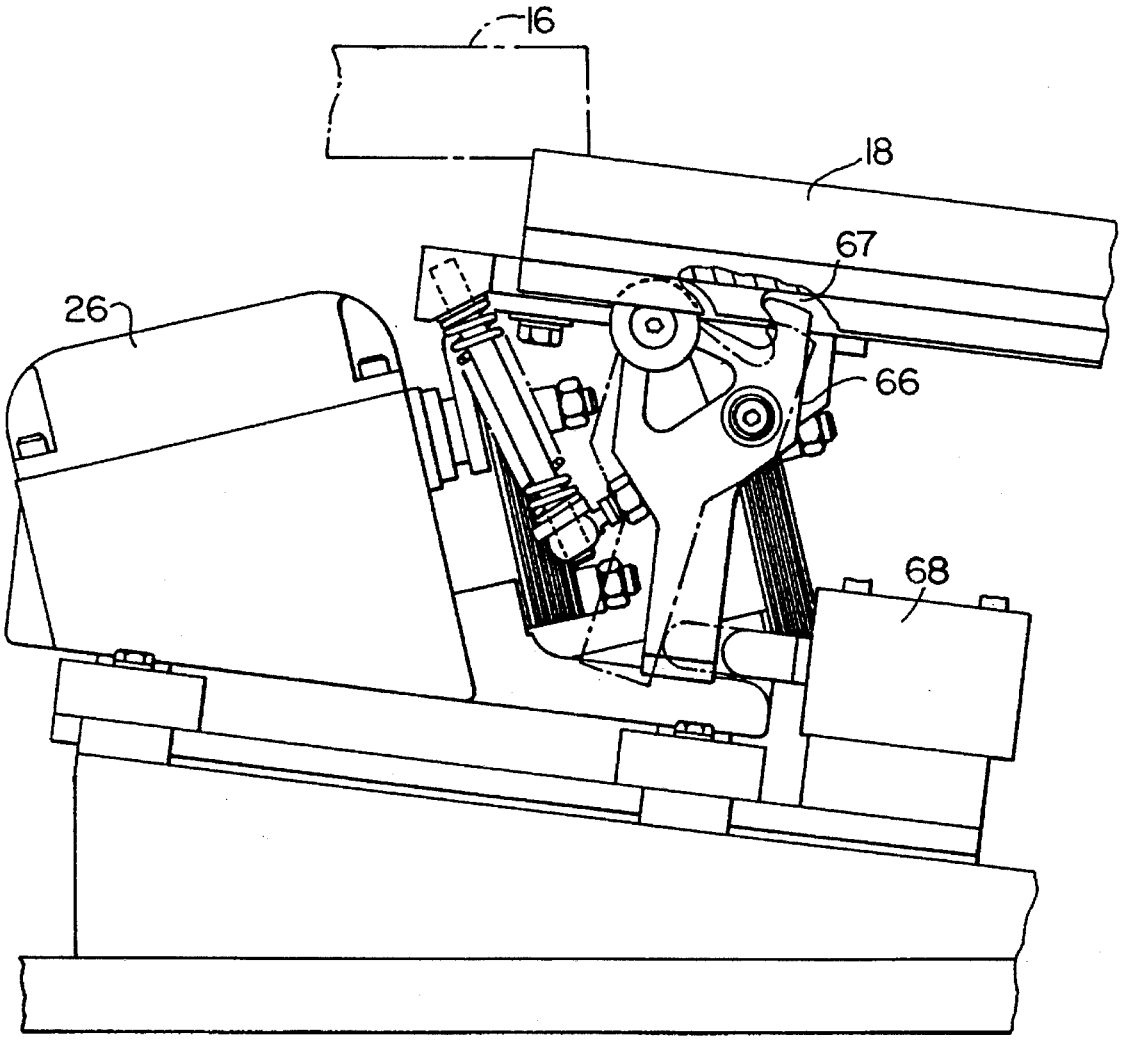
FIG. 7 is a side elevation of the vibrator and associated latch for the feed tray of the apparatus shown in FIG. 1.

Referring now to FIG. 7, the main feed tray 18 may also be quickly mounted and detached from the frame and housing assembly for processing different products and/or cleaning the apparatus. The vibrator 26 includes a pair of tray latches 66 (one shown) which mate with corresponding slots 67 formed in the underside of the main feed tray 18. The tray latches are spring biased in the latch position (shown in solid line), wherein the latches engage the slots in the tray, and an associated pneumatic actuator 68 is provided to move each latch to the unlatched position (shown in dashed line) for removal of the tray.

Figure 8:
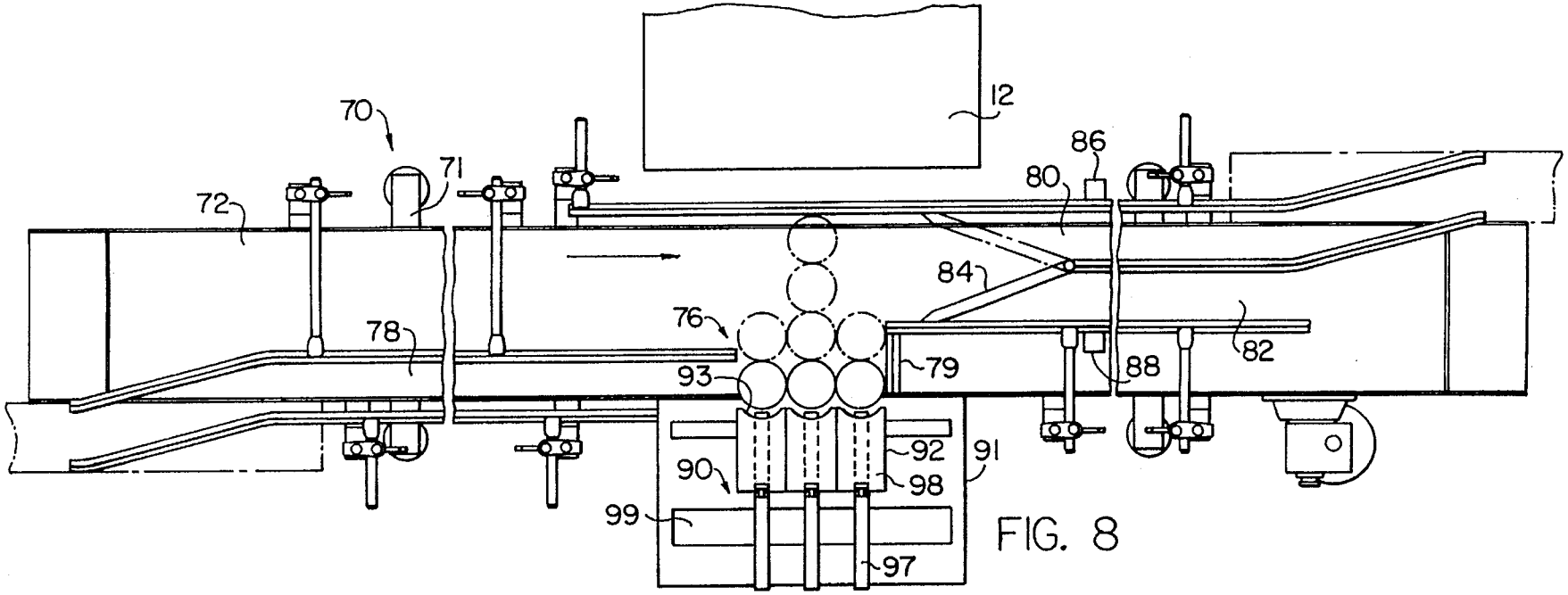
FIG. 8 is a top plan view of the conveyor and bottle-actuator assembly of the apparatus of FIG. 1 for transporting containers to be filled.

As shown in FIGS. 1 and 8, a conveyor and bottle-actuator assembly 70 is mounted on a movable frame 71 in front of the transportable housing and frame assembly 12 and beneath the collection block 22 to fill containers with singularized objects as they are discharged through the chutes 33. As shown in further detail in FIG. 8, the assembly 70 comprises a closed-loop conveyor 72 for transporting containers, in this case substantially cylindrical-shaped bottles 34, to and from a fill station 76 located beneath the chutes 33. The housing and frame assembly 12 is provided with an hydraulic system to raise and lower the assembly and adjust its height relative to the conveyor, if necessary.

The conveyor 72 defines an entry guide path 78, which is slightly wider than each bottle 34, thus causing the bottles to form a single file as they are transported toward the inlet side of the filling station and against the stop bar 79, in the direction indicated by the arrow in FIG. 8. On the outlet side of the filling station, the conveyor defines an outlet guide path 80 and a parallel reject path 82. A diverter gate 84 is pivotally mounted between the outlet and reject paths, and is coupled to an actuator (not shown) to move the diverter between a first position to normally guide the filled containers into the outlet path 80, as shown in solid lines in FIG. 6, and a default position to direct any reject bottles into the reject path 82, as shown in dashed lines in FIG. 8. An outlet sensor 86 is mounted adjacent to the outlet path 80, and is preferably an opto-electric sensor to sense the passage of each container passing through the outlet path. A reject sensor 88 is mounted adjacent to the reject path 82, which is preferably also an opto-electric sensor to sense the passage of each rejected container into the reject path.

Figure 9:
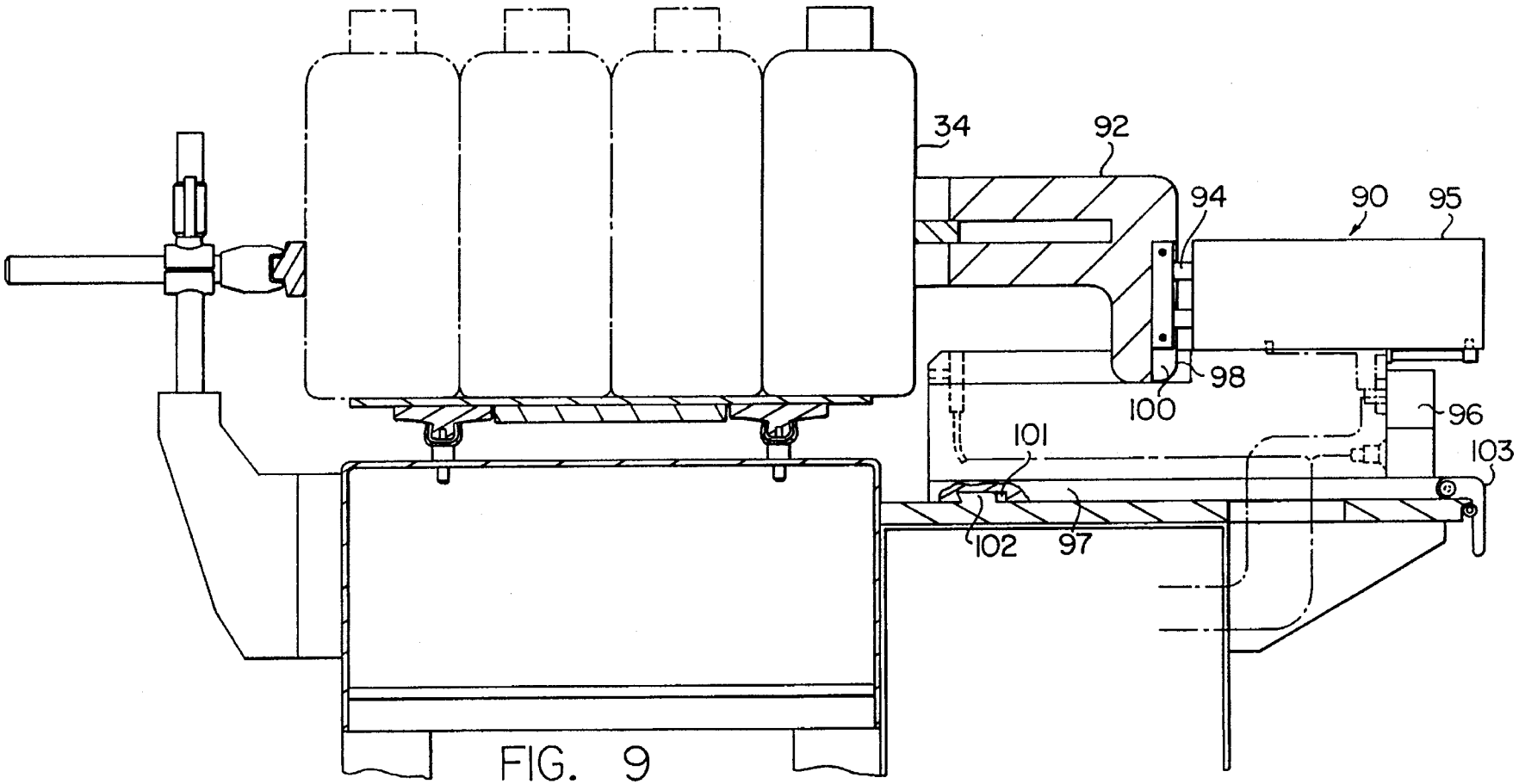
FIG. 9 is a partial section of the bottle actuator illustrated in FIG. 8.

Referring now to FIGS. 8 and 9, a series of bottle actuators 90 are mounted on support 91 adjacent to the filling station 76 on one side of the conveyor. Each bottle actuator 90 comprises a bottle pusher 92 detachably mounted to a double drive arm or piston 94, which is in turn mounted within a respective pneumatic cylinder 95 having an associated solenoid valve 96. The cylinder is supplied with pressurized air and the valve with electrical power through support manifold 97. Access for the air and electrical lines carried within the manifold is provided by opening 99 in support 91. The piston is normally air activated in the retracted position shown in FIG. 8, and the solenoid valve actuates the piston to an extended position (not shown) wherein the bottle in contact with the pusher 92 is positioned beneath the chute 33.

As shown in FIG. 8, each pusher 92 defines a curved surface 93 on one end shaped to substantially conform to the curvature of the respective bottle or container being processed, and as shown in FIG. 9 defines on its opposite end a slot 98 communicating with a hollow cavity 100 open on the underside of the pusher for receiving and encapsulating the free end of the respective piston 94. Accordingly, each pusher 92 is detachably mounted to the respective piston 94 to permit the pushers to be removed and replaced without tools to process different types of containers by simply lifting each pusher upwardly and away from the respective drive arm.

Further, each manifold 97 defines a notch 101 on its underside to receive and encapsulate a rail 102 mounted on the support 91 to align the respective bottle actuator with the fill station. Each bottle actuator 90 also comprises a latch 103 pivotally mounted to the backside of the respective manifold 97 to secure the actuator to the conveyor without tools once the manifold is slid into place. As with the gating manifold described above, the bottle actuators 90 and/or the pushers 92 can be quickly and easily removed and replaced without any tools to accommodate different types of containers and/or different numbers of actuators, thus facilitating a rapid changeover for processing different products.

Figure 10:
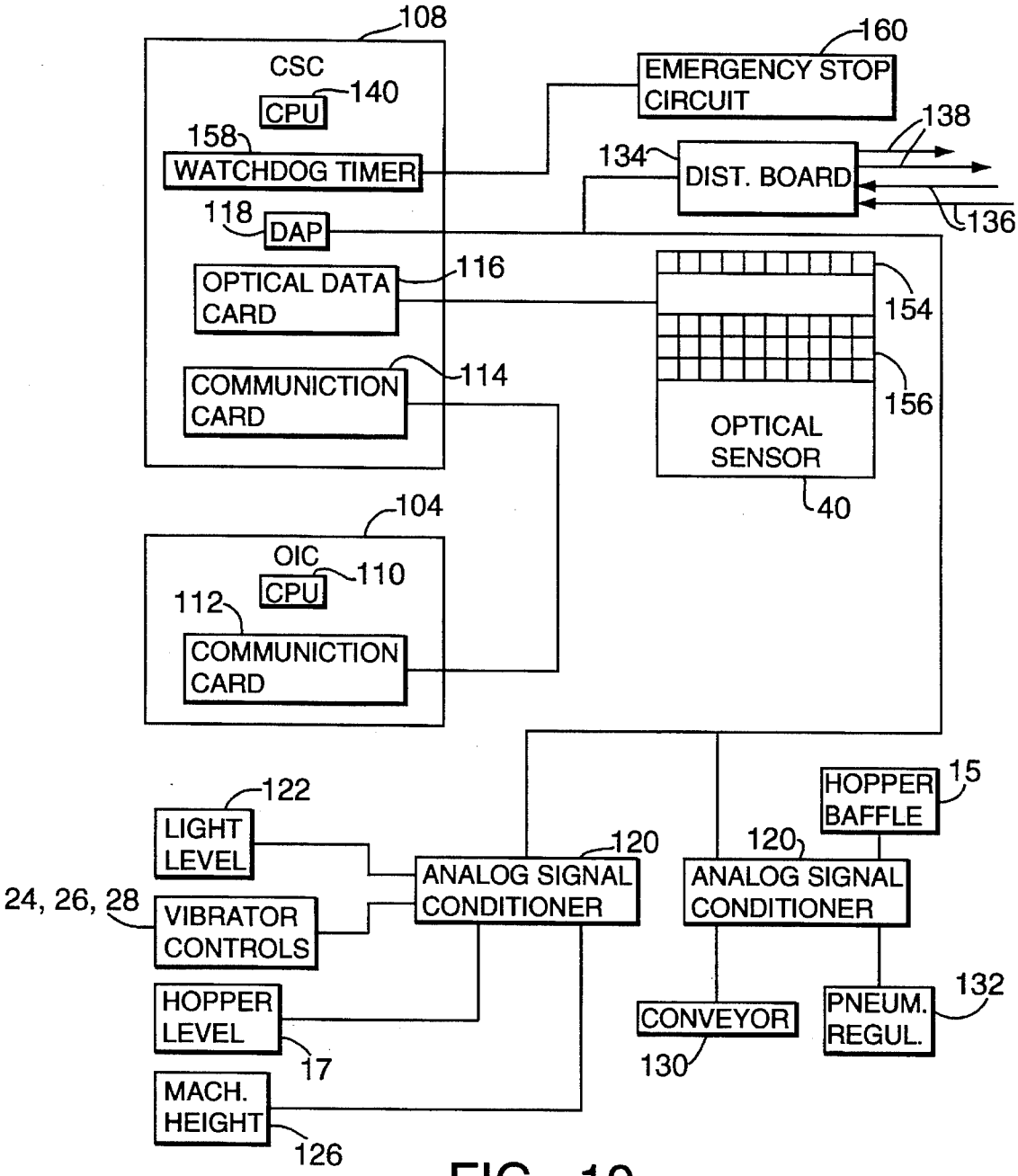
FIG. 10 is a block diagram of the electronic control components of the apparatus of FIG. 1 for automatically counting and packaging objects into containers.

With reference to FIGS. 1 and 10, the apparatus 10 further comprises an operator interface computer (OIC) 104 carried by a swing-arm 106 on the housing and frame assembly 12, and a control system computer (CSC) 108 coupled to the OIC and mounted within the housing and frame assembly. The OIC 104 is preferably a touch-screen type personal computer comprising a central processing unit (CPU) 110 and a communication card 112 coupled through a serial port to a corresponding communication card 114 on the CSC. The OIC enables operator interaction with the CSC 108 to control the automatic operation of the apparatus, including setting operating characteristics for the CSC, providing status information, and to enable troubleshooting, testing and communication with external computers to inquire, for example, about production data.

The CSC 108 further comprises an optical data card coupled to the optical sensor 40 for receiving the object image data, and a data acquisition processor (DAP) 118 for performing digital and analog input and control. The DAP 118 is coupled to a pair of analog signal conditioners 120 for receiving sensor signal data and controlling machine components throughout the apparatus. As indicated in FIG. 10, the first analog signal conditioner 120 is coupled to a light level sensor 122 for sensing the light intensity of the background light 42, and the vibrator controls for controlling the vibrator 24 coupled to the prefeed tray, and the first and second vibrators 26 and 28 coupled to the main feed tray. An opto-electric sensor 17 is mounted on the hopper 14, as shown in FIG. 1, and is likewise coupled to the first signal conditioner 120 for transmitting signals indicative of the product level in the hopper. Another sensor 126 is coupled to hydraulic actuators located on the base of the apparatus (not shown) for adjusting the level of the apparatus, and transmits signals to the first signal conditioner indicative of the machine height or level. The second signal conditioner 120 is coupled to a hopper baffle 15 for adjusting the rate at which objects are discharged from the hopper 14. The second signal conditioner 120 is also coupled to a conveyor motor 130 for controlling the speed of the conveyor 72, and to a pneumatic regulator (not shown) for controlling the air pressure to pneumatic components throughout the apparatus.

The DAP 118 is also coupled through a multiplexer distribution board 134 to a plurality of digital input ports 136 and digital output ports 138 for obtaining status information and controlling all digital components throughout the apparatus. Accordingly, the output ports 138 are coupled through the electrical connectors 56 and 58 to each of the solenoids 50 of the gating manifold 44 to control the discharge of singularized objects into containers, as described further below. Output ports 138 are also coupled to the cylinder and pneumatic valve assemblies 96 of the bottle actuators 90 to control the indexing of bottles through the filling station 76, and to the actuator (not shown) of the diverter gate 84 to control reject processing. The input ports 136, on the other hand, are coupled to the outlet sensor 86 and reject sensor 88 to receive the signals transmitted therefrom.

The CSC 108 also includes a CPU 140 functioning as a data manager for organizing and controlling the operating sequence of the software code modules resident in the CSC, OIC 104 and optical sensor 40, and thus for controlling the automated operation of the apparatus.

During the run mode of the apparatus, the linear pixel array of the sensor, which is illustrated schematically as 154 in FIG. 10, repetitively scans the sensor slot 38 at a predetermined, substantially constant rate (i.e., "X" scans per second), thus scanning each singularized object as it passes over the slot between the transition piece 20 and collection block 22. As also shown in FIG. 10, the sensor 40 comprises a buffer 156 including a plurality of shift registers coupled to the linear pixel array 154 for receiving the image data from each scan. Accordingly, after each scan, a respective line of image data is transmitted to the first register of the buffer, indicating (1) the number of singularized objects scanned and the guide path associated with each such object, and (2) the width of each object scanned.

The number of objects scanned is based on the groups of pixels generating image data within each line scan. For example, if there are 12 guide paths and 128 pixels in the linear array, then approximately every 10 consecutive pixels are associated with a respective guide path. Thus, each group of consecutive pixels generating image data is indicative of an object scanned within the respective guide path, and the number of consecutive pixels is indicative of the width of the respective object. The length of each scanned object, on the other hand, is based on the number of consecutive scans for which the respective group of pixels generate image data.

As each line of image data is generated, it is read into the first register of the buffer 156, and each of the remaining registers are successively shifted to accommodate each new line of data. As the buffer is being filled with image data, logical comparisons are performed to connect the image data to the respective feed paths. Then, once the buffer is filled with data, the buffer is emptied and the image data is transmitted via the optical data card 116 to a buffer within the CPU 140.

Figure 11:
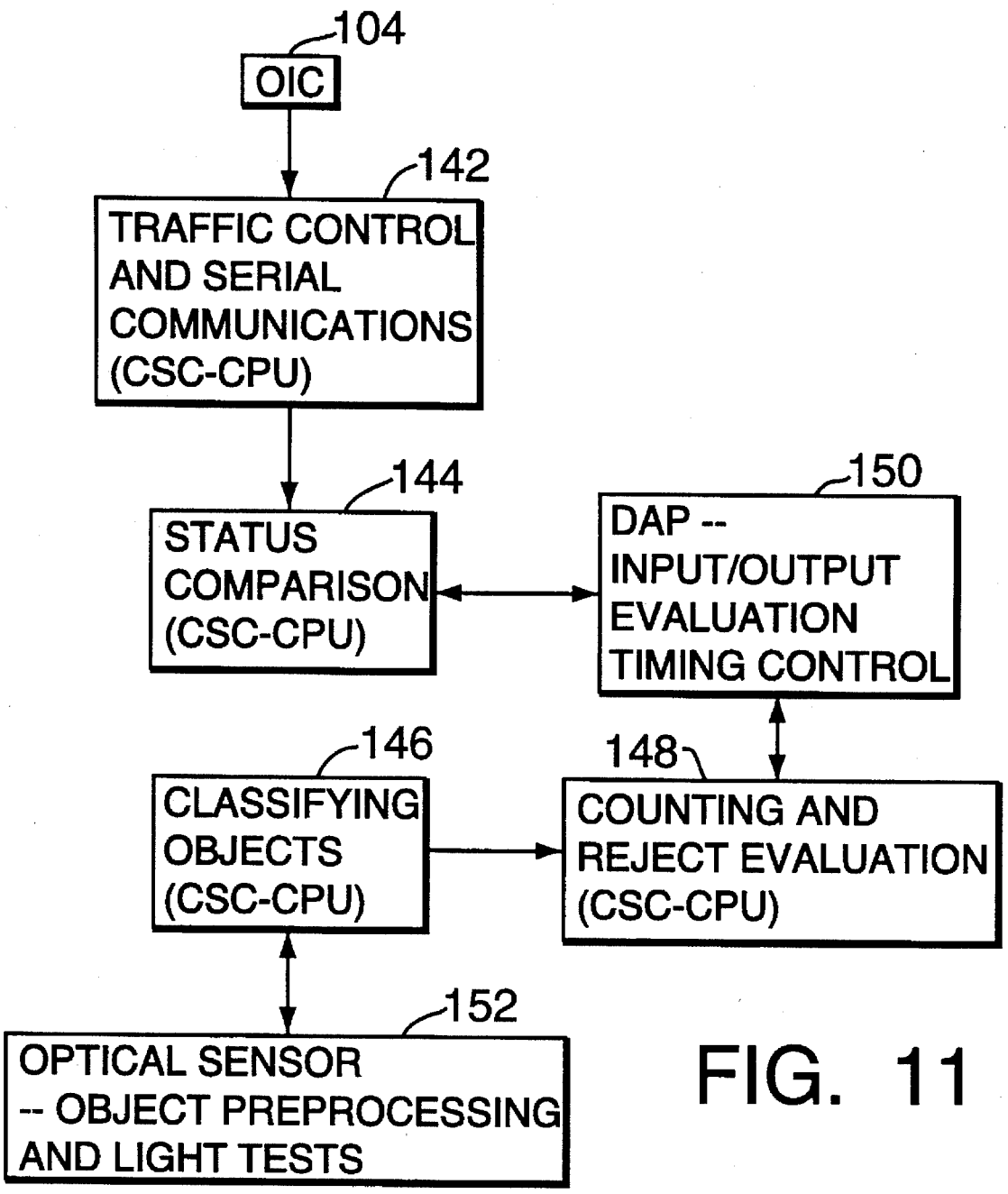
FIG. 11 is a block diagram illustrating the software code modules for automatic control and operation of the appartus of FIG. 1.

Referring now to FIG. 11 and with reference to the classifying objects module 146, once the end of the image data for each respective object is transmitted from the optical sensor 40, this module matches each object to its respective guide path, and assesses the length and area of each object. As described above, the length determination is made based on the number of scans of image data corresponding to the respective object, and the area determination is made based on the number of consecutive pixels transmitting the image data. This module then compares the length data (e.g., "x" number of scans) and the area data (e.g., "y" number of pixels) to predetermined set points for the particular type of product being processed, and transmits a classification flag corresponding to the respective object indicative of the results to the counting and reject evaluation module 148. If the length and area determinations are within predetermined acceptable ranges, then a "good" flag is transmitted. If, on the other hand, the product is over sized in either respect, an "over sized" flag is transmitted, and if under sized in either respect, an "under size" flag is transmitted.

The counting and reject evaluation module 148 assigns a counter to each guide path, and based on the respective guide paths discharging into each funnel 32, this module continuously counts the total number of objects discharged through each funnel into a respective bottle. The module 148 also evaluates the classification flag for each object, and based on the over size, under size, and over count set points set for the particular product, determines when to terminate filling each container. For example, if the set points for the product being processed permit 3 reject objects per bottle (e.g., either over sized or under sized), and if the classification module 146 indicates that 2 reject objects were discharged into a respective bottle, the evaluation module 148 can be set to accept and/or additionally could permit 2 additional "good" objects to be discharged into the respective bottle to compensate for the reject objects. If, on the other hand, a fourth reject is detected before the respective bottle is filled (i.e., before it reaches its count), a reject flag is generated to divert the rejected bottle into the reject lane 82 of the conveyor, as is described further below.

When each bottle is nearly filled, the module 148 transmits control signals to the input/output module 150 to successively close the gates discharging into the respective bottle. More specifically, once the object count for a respective bottle equals the fill number minus the number of guide paths discharging into the respective bottle (fill no.—no. of lanes per bottle), control signals are transmitted to sequentially close each gate upon discharging its next "good" object. For example, if the fill number for a particular product is 100 objects per bottle, and there are four guide paths discharging into each funnel and bottle, when the count reaches 96 (100−4) for a respective bottle, the module 148 transmits control signals to the DAP 118 to close each of the four guide paths upon discharging its next "good" object. Accordingly, after the 100th object is discharged, all four guide paths will be shut down. Once the last gate for a respective bottle is closed, the module 148 causes the DAP 118 to initialize a "settling" timer to permit the last objects in the respective count to drop and settle into the bottle, and the respective bottle-actuator 90 is not activated until the respective timer is completed.

While the above disclosure is sufficient for those skilled in the art to appreciate how the apparatus 10 operates, it should be recognized that the software modules are disclosed in more detail in commonly assigned patent application Ser. No. 08/285,898, entitled "APPARATUS AND METHOD FOR AUTOMATICALLY COUNTING AND PACKAGING DISCRETE OBJECTS", filed on even date herewith and incorporated herein by reference.

While preferred embodiments have been shown and described, various modifications and substitutions may be made without departing from the spirit and scope of the invention. Accordingly, it is to be understood that the present invention has been described by way of example and not by limitation.

We claim:

1. A device for separating and counting a pre-determined quantity of discrete objects, said device comprising:

a feed tray defining an axis extending between an inlet portion and a discharge portion of the tray, the tray including at least one guide path extending along the axis for the passage and singularization of objects, the guide path including a plurality of segments, each of the segments defining a direction of movement along the axis, wherein the direction defined by at least some of the segments is oriented at an angle with respect to the axis, the angle becoming decreasingly oblique toward the outlet portion of the tray;

first means for advancing objects along the guide path from the inlet portion to the discharge portion of the tray, the guide path effecting a singularization of the objects as the objects are advanced thereon;

second means for counting the quantity of singularized objects received at the discharge portion of the tray;

third means for interrupting the advancement of objects along the guide path when the quantity of objects counted equals the predetermined quantity, and control means connected to the second and third means for receiving data from the second means corresponding to the quantity of objects counted and for activating the third means to interrupt the advancement of objects when the data received corresponds to the predetermined quantity.

2. The device of claim 1 wherein the feed tray includes a plurality of guide paths and the control means activates the third means to interrupt the advancement of objects along a respective one of the guide paths when the data received for that guide path corresponds to the predetermined quantity.

3. The device of claim 2 wherein the control means combines data received for groups of at least two guide paths, and the control means activates the third means to interrupt the advancement of objects along a respective group when the combined data received for that group corresponds to the predetermined quantity.

4. The device of claim 2 wherein the third means comprises a plurality of gates, each one of the gates associated with a respective one of the plurality of guide paths and movable between an open position wherein objects advance along the guide path and a closed position wherein the advancement of objects along the guide path is interrupted;

said control means being connected to each one of the gates to alternately move each gate between the open and closed positions.

5. The device of claim 3 wherein the third means comprises a plurality of gates, each one of the gates associated with a respective one of the plurality of guide paths and movable between an open position wherein objects advance along the guide path and a closed position wherein the advancement of objects along the guide path is interrupted;

said control means being connected to each one of the gates to coordinate the movement of the gates associated with each one of the respective groups of at least two guide paths between the open and closed positions.

6. The device of claim 1 wherein the second means comprises means for measuring the length and area of objects.

7. The device of claim 6 wherein the second means comprises a camera for imaging objects, an optical sensor for registering the image as a pixel array, and a processor for converting the registered image into data to be forwarded to the control means.

8. The device of claim 1 wherein the guide path comprises a plurality of reversely arcuate segments, said segments increasing in radius from the inlet portion to the discharge portion of the tray.

9. An apparatus for packaging a predetermined quantity of objets, said apparatus comprising:

a feed tray defining an axis extending between an inlet portion and a discharge portion of the tray, the tray including at least one guide path extending along the axis for the passage and singularization of objects, the guide path including a plurality of segments, each of the segments defining a direction of movement along the axis, wherein the direction defined by at least some of the segments is oriented at an angle with respect to the axis, the angle becoming decreasingly oblique toward the outlet portion of the tray;

first means for advancing objects along the guide path from the inlet portion to the discharge portion of the tray, the guide path effecting a singularization of the objects as the objects are advanced thereon;

second means for counting the quantity of singularized objects received at the discharge portion of the tray;

third means for interrupting the advancement of objects along the guide path when the quantity of objects counted equals the predetermined quantity, and control means connected to the second and third means for receiving data from the second means corresponding to the quantity of objects counted and for activating the third means to interrupt the advancement of objects when the data received corresponds to the predetermined quantity;

means for transferring objects from the discharge portion of the tray to a container to fill the container with the predetermined quantity of objects;

means for delivering at least one empty container to a fill position for receiving the predetermined quantity of objects from the transfer means, and means for removing the filled container from the fill position.

10. The apparatus of claim 9 further comprising means for segregating filled containers containing damaged or defective objects.

11. The apparatus of claim 9 wherein the means for delivering at least one empty container to the fill position and for removing the filled container comprises a conveyor.

12. The apparatus of claim 9 further comprising indexing means associated with the conveyor for moving the at least one container from an infeed lane of the conveyor to the fill position and for moving the filled container from the fill position to a discharge lane of the conveyor.

13. The apparatus of claim 12 wherein the indexing means comprises a pusher movable between a retracted position, wherein empty containers are received by the indexing means from an infeed lane of the conveyor, and an extended position for moving empty containers to the fill position and filled containers to a discharge lane of the conveyor.

14. The apparatus of claim 9 wherein the guide path comprises a plurality of reversely arcuate segments, said segments increasing in radius from the inlet portion to the discharge portion of the tray.

15. The apparatus of claim 14 wherein the third means comprises a plurality of gates, each one of the gates associated with a respective one of the plurality of guide paths and movable between an open position wherein objects advance along the guide path and a closed position wherein the advancement of objects along the guide path is interrupted;

said control means being connected to each one of the gates to alternately move each gate between the open and closed positions.

16. The apparatus of claim 9 wherein the second means comprises means for measuring the length and area of objects.

17. The apparatus of claim 16 wherein the second means comprises a camera for imaging objects, an optical sensor for registering the image as a pixel array, and a processor for converting the registered image into data to be forwarded to the control means.

18. An apparatus for packaging a predetermined quantity of objets, said apparatus comprising:

a feed tray defining an axis extending between an inlet portion and a discharge portion of the tray, the tray including at least one guide path for the passage and singularization of objects, the guide path including a plurality of reversely arcuate segments, said segments increasing in radius from the inlet portion to the discharge portion of the tray;

first means for advancing objects along the guide paths from the inlet portion to the discharge portion of the tray, the guide paths effecting a singularization of the objects as the objects are advanced thereon;

second means for counting the quantity of singularized objects received at the discharge portion of the tray; the second means including a camera for imaging objects, an optical sensor for registering the image as a pixel array, and a processor for converting the registered image into data;

third means for interrupting the advancement of objects along the guide paths when the quantity of objects counted equals the predetermined quantity, the third means comprising a plurality of gates, each one of the gates associated with a respective one of the plurality of guide paths and movable between an open position wherein objects advance along the guide path and a closed position wherein the advancement of objects along the guide path is interrupted;

control means connected to the second and third means for receiving data from the processor corresponding to the quantity of objects counted and for actuating the gate associated with a respective one of the guide paths to interrupt the advancement of objects along that path when the data received corresponds to the predetermined quantity;

means for transferring objects from the discharge portion of the tray to a container to fill the container with the predetermined quantity of objects, and a conveyor for delivering at least one empty container to a fill position for receiving the predetermined quantity of objects from the transfer means, and for removing the filled container from the fill position.

* * * * *